US007379552B2

(12) United States Patent
Neervoort et al.

(10) Patent No.: US 7,379,552 B2
(45) Date of Patent: May 27, 2008

(54) SMART SPEAKERS

(75) Inventors: Paulus Cornelis Neervoort, Eindhoven (NL); Robert Kortenoeven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 308 days.

(21) Appl. No.: 10/527,117

(22) PCT Filed: Aug. 5, 2003

(86) PCT No.: PCT/IB03/03369

§ 371 (c)(1),
(2), (4) Date: Mar. 8, 2005

(87) PCT Pub. No.: WO2004/023841

PCT Pub. Date: Mar. 18, 2004

(65) Prior Publication Data

US 2006/0062401 A1 Mar. 23, 2006

(30) Foreign Application Priority Data

Sep. 9, 2002 (EP) ..... 02078665

(51) Int. Cl.
*H04R 29/00* (2006.01)

(52) U.S. Cl. ..... 381/58; 381/105; 455/3.06

(58) Field of Classification Search ..... 381/58–60, 381/111, 81, 27, 77, 105, 1–4, 30, 300, 311, 381/96, 82, 79–80; 455/73, 3.06, 575.1, 455/150.1, 3.03

See application file for complete search history.

(56) References Cited

U.S. PATENT DOCUMENTS

| | | | | |
|---|---|---|---|---|
| 5,313,524 | A * | 5/1994 | Van Hulle et al. | 381/105 |
| 5,386,478 | A * | 1/1995 | Plunkett | 381/103 |
| 6,118,880 | A * | 9/2000 | Kokkosoulis et al. | 381/303 |
| 6,954,538 | B2 * | 10/2005 | Shiraishi | 381/105 |
| 7,076,204 | B2 * | 7/2006 | Richenstein et al. | 455/3.06 |
| 7,095,455 | B2 * | 8/2006 | Jordan et al. | 348/734 |

FOREIGN PATENT DOCUMENTS

| | | | |
|---|---|---|---|
| DE | 19646055 | A1 | 5/1998 |
| JP | 2002/078037 | A | 3/2002 |
| WO | WO02056635 | A2 | 7/2002 |
| WO | WO02056635 | A3 | 7/2002 |

* cited by examiner

*Primary Examiner*—Vivian Chin
*Assistant Examiner*—Lun-See Lao

(57) ABSTRACT

This invention relates to a method (and corresponding system) for providing location-aware media information and more specifically a method for providing location-aware audio content by an audio-presenting device capable of presenting audio content. On the audio source (401) comprising processing means (301) one or more sensors (404), may be positioned in order to locate the position(s) of one or more audio-presenting devices attached, close, or distant to said audio source. The sensors are used by receiving signal (s) to determine the location of the available audio-presenting devices. The audio-presenting device's (402, 403) location relative to the user's working position—in front of the display device (406)—may be estimated by the audio source (401) and thereby provides information items to the audio-presenting devices (402, 403) by the method according to the present invention so as to provide desired sound signals.

11 Claims, 5 Drawing Sheets

SMART SPEAKERS

FIELD OF THE INVENTION

This invention relates to a method for providing location-aware media information and more specifically a method for providing location-aware audio content by an audio-presenting device capable of presenting audio content.

The present invention also relates to a system for performing the method and a computer program for performing the method.

BACKGROUND OF THE INVENTION

DE 196 46 055 discloses an audio playback system comprising a reproducing device, a speaker system, and a signal-processing unit for improving the spatial experience to a listener by applying psycho-acoustic signal processing. Physical placement of a speaker system is assisted by processing the presented audio to e.g. compensate the speed of audio in air. The audio output from a source is processed with effects to trick the listening ears in believing that the presented audio is coming from a direction where no speaker is actually placed.

This type of audio processing to e.g. virtually expand the size of the room and/or virtually displace sounds is commonly used in conjunction with consumer-related media productions where the size of the room and/or the number of surrounding speakers are limited. The processed and imaged/mirrored audio does not necessarily reflect the actual placement of musical instruments as they were recorded, but mostly introduces a feel of another location i.e. a concert hall, a church, an outdoor scene, etc. To obtain information of the actual placement of the physically available speakers in a system it may, however, be necessary to provide a calibration procedure prior to processing the sound source to compensate room characteristics, etc. This calibration may comprise an impulse response for each of the available speakers, where the impulse response may comprise speaker-independent characteristics such as group delay and frequency response, etc.

In a special audio-optimized environment, e.g. a soundproofed chamber, such a method may be sufficient to obtain an acceptable impulse response to desirably render an audio signal.

However, in a real environment, such as a living room or a kitchen, etc., it is a very difficult challenge to obtain authentic impulse responses to accomplish trustworthiness by the listener due to room reverberations, background noise, placement of probe microphones etc. during the calibration procedure.

To process the audio optimally with respect to audio placement, it may not be necessary to inquire impulse responses for the speaker system. It may be necessary for the processing unit to know the exact placement of speakers and the listener for estimation of acceptable processing schemes.

The human ear tolerates a slight deviation in speaker placement, but it is not possible to convince a listener that a sound is coming from the left speaker, when it is actually being played from e.g. the right speaker. Therefore, to satisfy and convince a listener of a speaker placement, the speaker actually has to be placed relatively near the intended location of the sound.

For this sake, it may be convenient to physically place a speaker on a chosen spot and let this speaker play material that may be appropriate for this location.

For example, if a speaker playing music is placed close to a listener, the listener may observe a given level of sound. If the speaker is placed at a longer distance from the listener, the playing speaker must carry out more power to let the listener obtain the same sound level as when the speaker is placed closer to him.

An example of the use of a speaker system according to the present invention could be watching a concert on television where an organ is playing on the left and a guitar is playing on the right. Positioning an audio-presenting device on the left would present the sound of the organ, positioning the audio-presenting device on the right would otherwise present the sound of the guitar.

In a stereo system where a left and a right audio signal is represented but only one loudspeaker placed to the left of a listener is available, it may be desirable to only reproduce the left signal to avoid spatial confusion of the listener. Likewise, if the loudspeaker is placed in front of the listener, the reproduced audio may comprise an appropriate mix of the left and the right audio channel.

Likewise, this may also be the situation in a surround sound environment, where a number of loudspeakers (typically 4 to 6) are placed around the listener to generate a 3D-like sound image. The speaker location is essential to e.g. instrument placement and accurate mirroring of acoustic spaces for high precision sound positioning. Unless e.g. the rear speakers (the speakers positioned behind the listener) in a surround sound setup are placed exactly symmetrically relative to the listener, undesirable effects may be apparent such as e.g. non-uniform sound delay, sound coloration, wave interference, etc. In addition, if the front speakers in a surround sound environment are placed further apart from the user than the rear speakers, a front/rear balance control of e.g. an amplifier has to be adjusted to prevent the rear speakers from dominating the sound image. However, the sounds coming from the rear speakers still arrive first at the listener by way of the physically shorter distance. This disadvantage is typically disregarded in home theatre arrangements.

A speaker system according to the present invention provides users with a system that enables them to position speakers in a space relative to the current auditory content without troublesome speaker/amplifier adjustments.

For processing the audio according to the speaker placement, it is necessary for the sound system to identify the loudspeaker location. It may be difficult and sometimes even impossible for a user to enter the exact location of a loudspeaker. Therefore it may be advantageous if the sound system is able to automatically determine the speaker placement prior to signal processing.

With that, the user can add audio-presenting devices without having to enter any software-based set-up programs or adjusting any system setting. All the user has to do is position the speaker somewhere within the useful area and the processing unit will determine which auditory signals will be presented through the audio-presenting device.

OBJECT AND SUMMARY OF THE INVENTION

It is an object of the invention to solve the above-mentioned problem of speaker placement without user interference.

This is achieved by a method (and corresponding system) of providing location-aware audio content by an audio-presenting device capable of presenting audio content, the method comprising the steps of obtaining, in a processing unit, at least one location parameter representing the location of the audio-presenting device; processing, in said processing unit, current audio content on the basis of the obtained at least one location parameter in order to obtain a location-aware audio content being relative to the current audio content dependent on the at least one location parameter; and presenting the obtained location-aware audio content by the audio-presenting device.

It is a further object of the invention to provide a method and system wherein the processing of audio content comprises processing steps considering audio capabilities of the audio-presenting device.

This invention provides a user with a system that enables him to position a speaker relative to a current auditory content without having to consider any programming of speaker placement. The system will determine which auditory signals will be presented through the speaker.

An audio-presenting device may be a speaker capable of reproducing audible signals, as well as signals inaudible to the human ear. In general, the idea of the present invention covers the automatic transfer of location-aware content from a source, i.e. the content of an audio source, to an audio-presenting device relative to its location.

Said audio source may be a personal computer, a television, a video camera, a game unit, a mobile phone, etc. capable of detecting said location(s) of an audio-presenting device, and capable of subsequently transferring a corresponding content to said audio-presenting device.

BRIEF DESCRIPTION OF THE DRAWINGS

Throughout the drawings, the same reference numerals indicate similar or corresponding features, functions, etc.

DETAILED DESCRIPTION OF EMBODIMENTS

Figure 1:
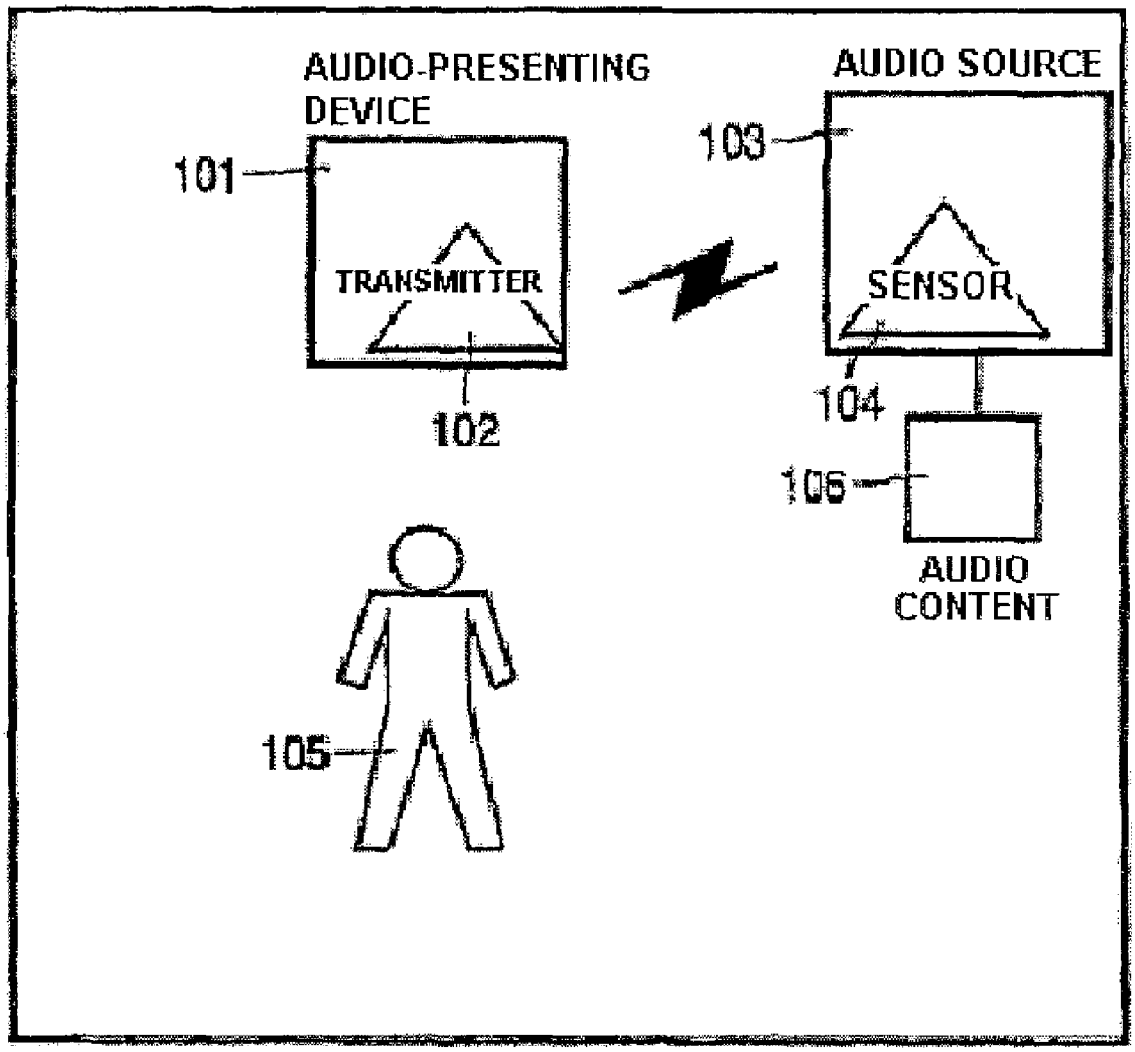
FIG. 1 shows an audio-presenting device connected to an audio source in a basic setup.

FIG. 1 shows an audio-presenting device, here a speaker unit, denoted by reference numeral (101) with one or more transmitters (102) placed in front of a listener denoted by reference numeral (105). On the audio source (103) one or more sensors, indicated by reference numeral (104), may be positioned in order to locate the position(s) of one or more audio-presenting devices attached, close, or distant to said audio source. The number of sensors are used, by receiving signal(s) sent from one or more transmitters positioned on or integrated in the audio-presenting device, to determine the location of the audio-presenting device(s). In other words, by means of said sensor(s), the audio source may locate said audio-presenting device(s). Subsequently, the audio source may determine information (dependent on said location) representing audio content (106) which has to be transferred and presented on said audio-presenting devices.

Figure 2:
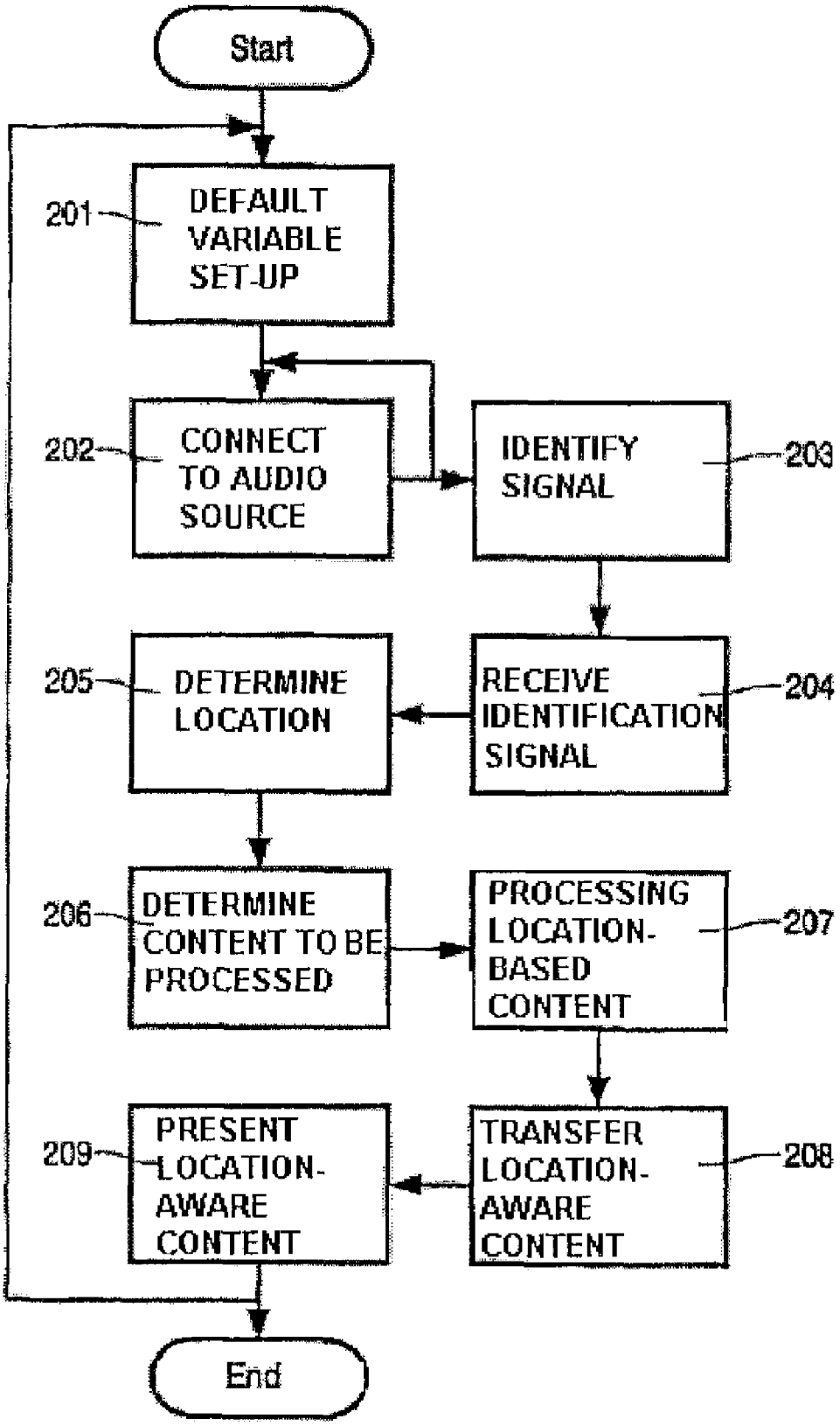
FIG. 2 shows a method of presenting content with an audio-presenting device.

FIG. 2 shows a method of presenting content with an audio-presenting device.

In step 201, the method in accordance with a preferred embodiment of the invention is started. Variables, flags, buffers, etc., keeping track of locations, content, information item(s), identifying signal(s), etc. corresponding to the status of audio-presenting devices located relative to an audio source and corresponding to the status of said audio source are set to default values.

In step 202, the audio-presenting device may be connected or attached to an audio source. This will typically be a user action in that the user may desire that the audio-presenting device may be in operation.

It may be the case that this step is repeated for more audio-presenting devices. The steps to be followed may then correspondingly apply.

In step 203, at least one transmitter—located on the audio-presenting device—preferably transmits a corresponding signal identifying the device. As discussed in FIG. 1, one or more transmitters may be positioned on or integrated in the audio-presenting device. This or these transmitter(s) may then be used to inform the audio source that said audio-presenting device is connected to it. Said signal may be used to identify the audio-presenting device, its type and characteristics, etc.

In step 204, at least one sensor may receive at least one identifying signal. Said sensor(s) is/are preferably located on the audio source. As discussed in the foregoing step and in FIG. 1, the identifying signal(s) is/are transmitted from one or more transmitters located on the audio-presenting device.

In step 205, the audio source may obtain a first location of the audio-presenting device.

In step 206, the audio source may determine, on the basis of obtained location information what content part or parts from the audio content has to be processed and played back subsequently on the audio-presenting device. It may be the case that this step is repeated for more audio-presenting devices. Based on one or more identifying signals, the audio source may determine specific X, Y, Z coordinates of the audio-presenting device. Said coordinates may be defined relative to a fixed point on the audio source or e.g. a location of the room, etc. and measured by it by means of received identifying signals(s).

Said audio content may be electric or acoustic signals, analog, digital, compressed or non-compressed audio, etc. or any combination thereof.

In step 207, the audio parts from step 206 are processed in order to obtain a location-aware audio content relative to the current audio content dependent on the at least one location parameter.

In step 208, the audio source may transfer context-aware audio content to the audio-presenting device. Said first information item may be transferred and then received by means of a network—as a general solution known from the prior art—or it may be received by means of an optimized communication dedicated to the audio-presenting device.

In step 209, the audio-presenting device may receive and present/reproduce said context-aware audio content.

The context-aware audio content (presented on said audio-presenting devices) may further be dependent on what is currently presented on the audio source, as it may be convenient to present a part of what is currently presented on the audio source with e.g. different processing attributes, if any.

Throughout the application—when the wording "presentation", "present" or the like is used—it is understood to mean that content may be reproduced on a corresponding audio-presenting device.

The wording "content", is understood to be audio information typically played back on a personal computer, a television, a video camera, a game unit or a mobile phone, etc. Said information or content may be electric signals, compressed or non-compressed digital signals, etc. or any combination thereof.

Figure 3:
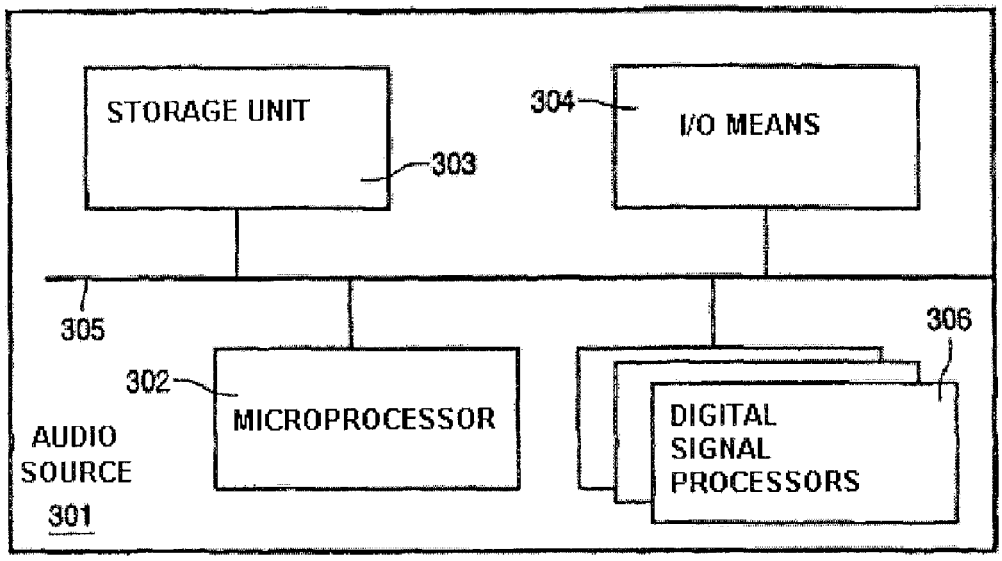
FIG. 3 illustrates a schematic block diagram of a processing unit in an audio source.

FIG. 3 illustrates a schematic block diagram of an embodiment of an audio source (301) comprising one or more microprocessors (302) and/or Digital Signal Processors (306), a storage unit (303), and input/output means (304) all connected via a data bus (305). The processor(s) and/or Digital Signal Processor(s) (306) are the interaction mechanism among the storage unit (303) and the input/output means (304). The input/output means (304) is responsible for communication with the accessible sensor(s), wherein transport of received location parameters, etc. may occur during operation. Location parameters can be uploaded from remote audio-presenting devices via the input/output means (304). This communication between an audio-presenting device and the sensor(s) may take place e.g. by using IrDa, Bluetooth, IEEE 802.11, wireless LAN, etc. but will also be useful in a wired application solution. The storage unit (304) stores relevant information like a dedicated computer program or uploaded location parameters for determination of available resources, processing algorithms, etc.

Digital Signal Processors may be dedicated programmed for different processing tasks such as decoding, encoding, effect layering, etc. Either a single multi-issue DSP may comprise several processing means or a multiple of DSPs can be nested to perform processing tasks where each DSP is dedicated to fewer processing means than the single multi-issued DSP.

The overall processing may also be comprised in a single general-purpose processor comprising software for a multitude of tasks, wherein processes are defined among different processing functions. The use of general-purpose microprocessors, instead of DSPs, is a viable option in some system designs. Although dedicated DSPs are well suited to handle signal-processing tasks in a system, most designs also require a microprocessor for other processing tasks such as memory managing, user interaction, relative location estimation, etc. Integrating system functionality into one processor may be the best way to realize several common design objectives such as lowering the system part count, reducing power consumption, minimizing size, and lowering cost, etc. Reducing the processor count to one also means fewer instruction sets and tool suites to be mastered.

Furthermore, the invention relates to a computer-readable medium containing a program for making a processor carry out a method of providing location-aware media content by an audio-presenting device (101) capable of presenting audio content (106), the method comprising the steps of obtaining, in a processing unit (103), at least one location parameter representing the location of the audio-presenting device (101); processing, in said processing unit (103), current audio content on the basis of the obtained at least one location parameter in order to obtain a location-aware audio content being relative to the current audio content dependent on the at least one location parameter; and presenting the obtained location-aware audio content by the audio-presenting device (101).

In this context, a computer-readable medium may be a program storage medium i.e. both physical computer ROM and RAM, removable and non-removable storage drives, magnetic tape, optical disc, digital versatile disc (DVD), compact disc (CD or CD-ROM), mini-disc, hard disk, floppy disk, smart card, PCMCIA card, information acquired from data networks e.g. a local area network (LAN), a wide area network (WAN), or any combination thereof, e.g. the Internet, an intranet, an extranet, etc.

Figure 4:
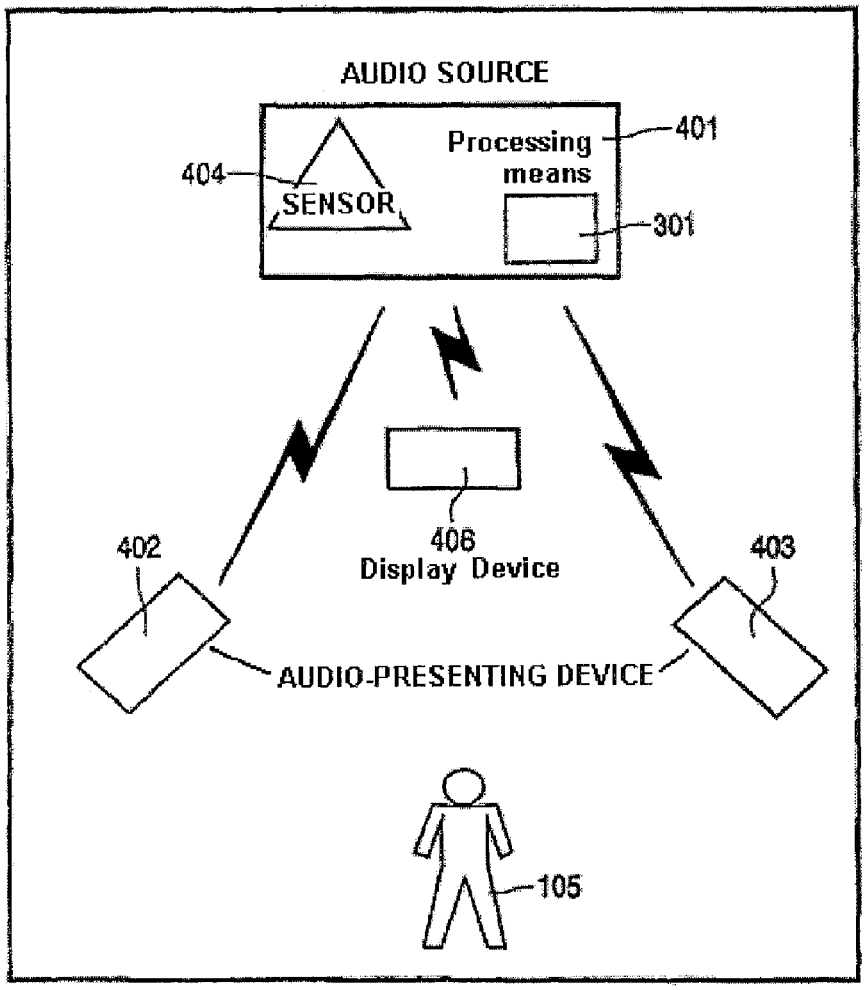
FIG. 4 shows a setup with two audio-presenting devices with location reference to a display device.

FIG. 4 shows a setup with two audio-presenting devices (402, 403) with location reference to a display device denoted by reference numeral (406) all with one or more transmitters (not shown) placed in front of a listener denoted by reference numeral (405). On the audio source (401) comprising processing means (301) one or more sensors, indicated by reference numeral (404), may be positioned in order to locate the position(s) of one or more audio-presenting devices attached, close, or distant to said audio source. The sensors are used, by receiving signal(s) sent from one or more transmitters positioned on or integrated in the audio-presenting devices, to determine the location of the available audio presenting devices. The audio-presenting device's (402, 403) location relative to the user's working position—in front of the display device (406)—maybe estimated by the audio source (401) and thereby provides information items to the audio-presenting devices (402, 403) by the method described hereinbefore to provide desired sound signals accordingly.

The audio source may be supported by surround-sound technologies capable of sending audio information to individual channels, and thereby different audio-presenting devices, to generate a 3d-like sound-image. By gathering location placement parameters of the individual audio-presenting devices at different locations, appropriate audio processing may be executed in order to spatially enhance a listening experience.

Correspondingly, the audio-presenting device(s) is/are connectable and/or attachable to the audio sources or may be placed relative to the audio source and there connected to it, and furthermore, the audio-presenting device is capable of receiving and presenting content from the audio source.

Figure 5:
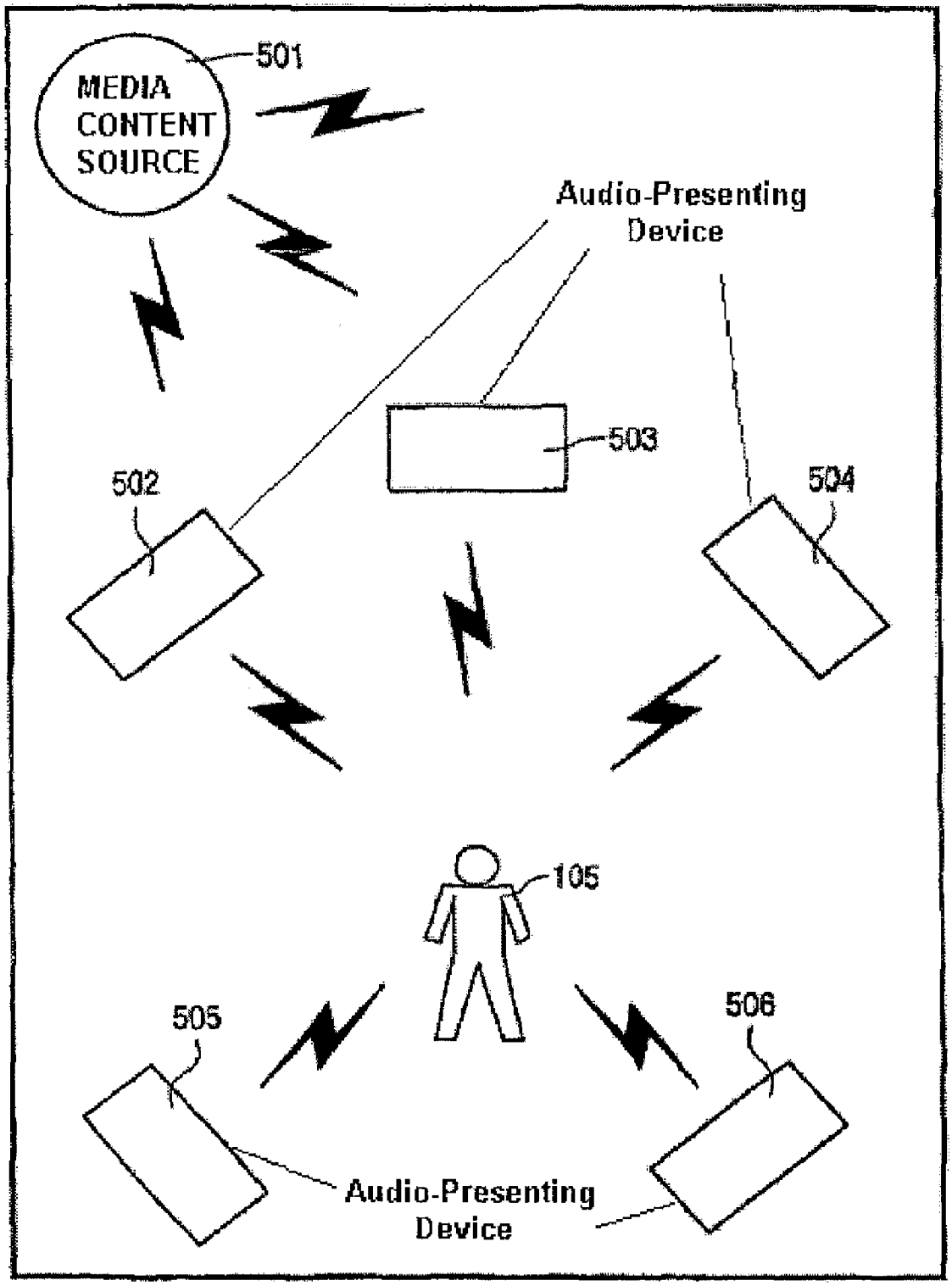
FIG. 5 shows another embodiment of the present invention.

Another example of an embodiment of the present invention can be seen in FIG. 5 wherein a media content source (501) transmits all available audio content without the above-mentioned processing prior to transmission. In this example, content processing is carried out in the audio-presenting devices (502, 503, 504, 505, 506), a number of devices comprising processing means (not shown), prior to user presentation. Each audio-presenting device comprises means (not shown) for receiving media content transmitted from the content source (501) and means for obtaining location parameters relative to a user (505). The user (505) may wear, or be attached to, location transmitting means (not shown) to inform any audio-presenting devices of its position.

Furthermore, each audio-presenting device may comprise processing means as described in the foregoing to process the media content accordingly to the location of the audio-presenting devices relative to the user's position.

For example, if the audio-presenting device (503) in front of the user determines that it is located directly in front of the user, it may be determined by the device that this should reproduce the center channel in a 5.1 surround signal. If, for example, the media content is available in stereo only, it may be determined by the front audio-presenting device to reproduce an appropriate mix of the left and the right audio channel, etc.

Furthermore, the processing of media content may comprise capabilities of the available audio-presenting devices. For example, if a loudspeaker is only capable of reproducing signals in the frequency range of 10-200 Hz, but the media content comprises signals outside that range and i.e. therefore should be reproduced, this audio-presenting device limitation may be considered in the processing steps. This lack of reproduction possibility may be compensated in the processing steps by e.g. processing media content for other audio-presenting devices accordingly, if any.

Figure 6:
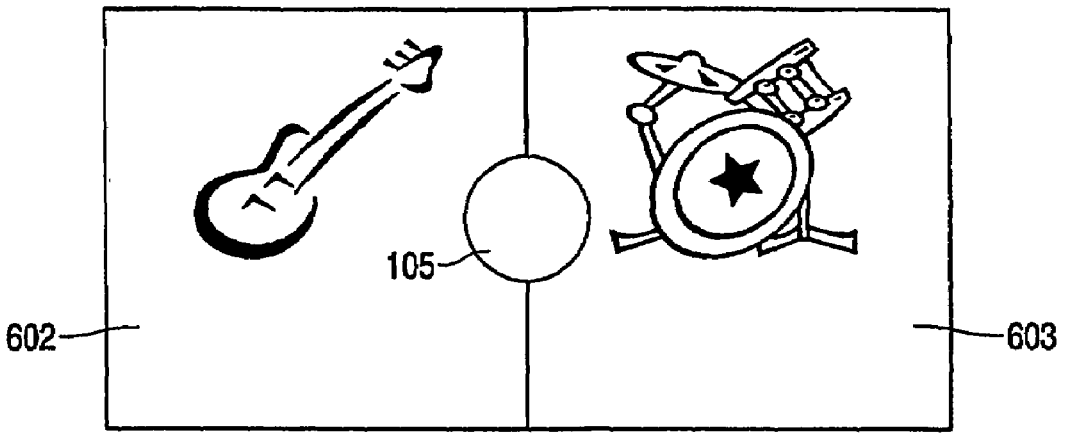
FIG. 6 illustrates a schematic block diagram of musical instruments placed in a stereophonic reproduction setup.

FIG. 6 illustrates a schematic block diagram of musical instruments placed in a stereophonic reproduction setup. The stereo recording comprises a guitar on the left channel (602) and a drum set on the right channel (603). When placing an audio-presenting device according to the invention at the far right side (603) of the listener (105), the audio device may be configured to only play the sounds coming from the drum set. Placing the audio-presenting device to the far left of the listener (105) may result in presenting only the guitar. If now, for example, the audio-presenting device placed to the far left is located in the same relative direction in relation to the listener but this time closer to the listener, the audio-presenting device may need to turn down the output power, in order to obtain an identical volume level of sound received by the listener.

Figure 7:
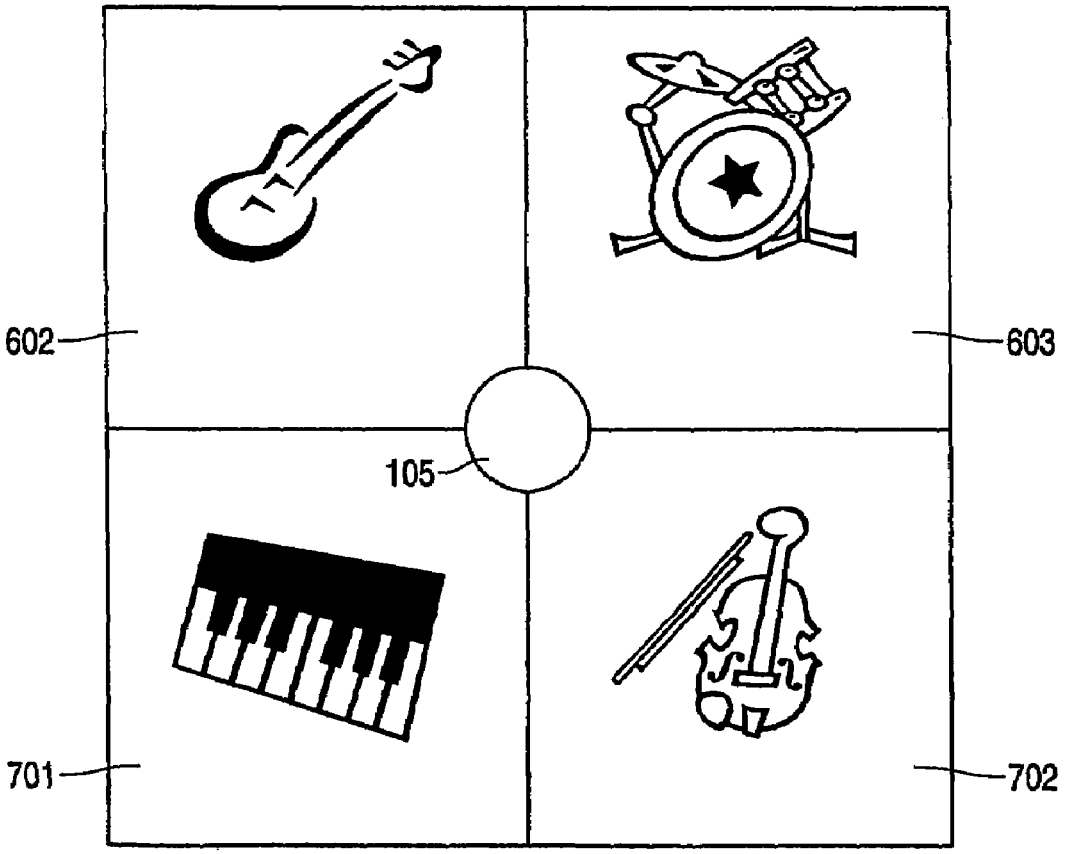
FIG. 7 illustrates another schematic block diagram of musical instruments placed in a quadraphonic reproduction setup.

FIG. 7 illustrates another schematic block diagram of musical instruments placed in a quadraphonic recording setup. Four separate tracks are recorded comprising guitar (602), drum set (603), piano (701), and a violin (702). To reproduce the same ambience during reproduction as in the recording stage, four audio-presenting devices placed around a listener (105) may be required. Similarly to the above-mentioned stereo recording, every audio-presenting device reproduces sonic material corresponding to its location. If placed symmetrically in a quadrant like the instruments in the Figure, every single audio device approximately plays back only a single instrument. If, for example, the audio-presenting device in the 3rd quadrant is turned off, no or only a little bit of piano (701) may be found in the acoustic image.

Placing a speaker in the middle of the quadrant may e.g. reproduce all of the four instruments.

While the description above refers to particular embodiments of the present invention, it will be understood by those skilled in the art that many details provided above have been described by way of example only, and modification may be made without departing from the scope thereof.

The accompanying claims are intended to cover such modifications as would fall within the true scope and spirit of the present invention. The disclosed embodiments are therefore to be considered in all respects as illustrative and not restrictive, the scope of the invention being indicated by the appended claims, rather than the foregoing description, and al changes coming within the meaning and range of equivalency of the following claims are therefore intended to be embraced therein

The invention claimed is:

1. A method of providing location-aware media content by an audio-presenting device (101) capable of presenting audio content (106), the method comprising the steps of: obtaining, in a processing unit (103), at least one location parameter representing the location of the audio-presenting device (101) using a wireless communication between the processing unit and the audio-presenting device; processing, in said processing unit (103), current audio content on the basis of the obtained at least one location parameter in order to obtain a location-aware audio content being relative to the current audio content dependent on the at least one location parameter; and presenting the obtained location-aware audio content by the audio-presenting device (101).

2. A method as claimed in claim 1, wherein the processing unit (103) comprises the steps of: receiving the at least one location parameter from the audio-presenting device (101); and transmitting the obtained location-aware audio content to the audio-presenting device (101) prior to presenting the same.

3. A method according to claim 1, wherein the processing unit is comprised by an audio-presenting device (502, 503, 504, 505, 506), and comprises the steps of: receiving the current audio content; and presenting the obtained location-aware audio content by the audio-presenting device (502, 503, 504, 505, 506).

4. A method according to claim 1, wherein said at least one location parameter is determined as a parameter relative to a user's workspace.

5. A method according to claim 1, wherein the steps of processing audio content comprise processing by using audio reproduction capabilities of the audio-presenting device.

6. A system for providing location-aware media content by an audio-presenting device (101) capable of presenting audio content (106), the system comprising means for: obtaining, in a processing unit (103), at least one location parameter representing the location of the audio-presenting device (101) using a wireless communication between the processing unit and the audio-presenting device; processing, in said processing unit (103), current audio content on the basis of the obtained at least one location parameter in order to obtain a location-aware audio content being relative to the current audio content dependent on the at least one location parameter; and presenting the obtained location-aware audio content by the audio-presenting device (101).

7. A system according to claim 6, wherein the processing unit (103) comprises means for: receiving the at least one location parameter from the audio-presenting device (101); and transmitting the obtained location-aware audio content to the audio-presenting device (101) prior to presenting the same.

8. A system according to claim 6, wherein the processing unit is comprised by an audio-presenting device (502, 503, 504, 505, 506), and comprises means for: receiving the current audio content; and presenting the obtained location-aware audio content by the audio-presenting device (502, 503, 504, 505, 506).

9. A system according to claim 6, wherein said at least one location parameter is determined as a parameter relative to a user's workspace.

10. A system according to claim 6, wherein the steps of processing audio content comprise processing by using audio reproduction capabilities of the audio-presenting device.

11. A computer-readable medium containing a program for making a processor carry out the method of claim 1.

* * * * *